United States Patent [19]

Eisler

[11] 3,960,050

[45] June 1, 1976

[54] METHOD OF MAKING IMPREGNATED BRAIDED ROPE

[75] Inventor: Robert Eisler, Montreuil, France

[73] Assignee: Cordes Europe France, France

[22] Filed: July 17, 1974

[21] Appl. No.: 489,300

[30] Foreign Application Priority Data

Aug. 1, 1973 France.....73.28247

[52] U.S. Cl...... 87/1; 28/75 R; 57/164; 427/175; 427/394

[51] Int. Cl.[2]..... D04C 1/12

[58] Field of Search..... 87/1, 6, 8, 23; 57/149, 57/164, 6, 7, 153; 28/72 R, 75 R; 427/175, 381, 384, 390, 394, 412

[56] References Cited

UNITED STATES PATENTS

| | | | |
|---|---|---|---|
| 2,322,756 | 6/1943 | Wallder | 87/1 |
| 2,585,484 | 2/1952 | Menes | 87/6 X |
| 2,824,485 | 2/1958 | Gregory | 87/1 |
| 3,048,078 | 7/1962 | Kaplan | 87/1 |
| 3,079,665 | 3/1963 | Saylor | 87/1 X |
| 3,653,295 | 4/1972 | Pintard | 87/1 |

*Primary Examiner*—John Petrakes
*Attorney, Agent, or Firm*—Sherman Levy

[57] ABSTRACT

A method for the manufacture of fiber ropes, according to which a braid with or without a core is produced, and this assembly, made of high performance, degreased fibers is impregnated by passing it through an impregnation bath, containing polyester urethanes and some aromatic isocyanate, which constitutes the reticulant, and then drying.

7 Claims, 3 Drawing Figures

METHOD OF MAKING IMPREGNATED BRAIDED ROPE

The present invention relates to a method and plant for the manufacture of ropes and the ropes thus produced.

The utilisation of high performance textile ropes is increasing more and more, as they have many advantages over steel cables. They are light, flexible, dielectric, resistant to corrosion, especially that of sea water and chemical agents and, according to the type of fibre, they are thermostable and non-inflammable.

Such ropes are used at present in many fields, namely, as stay wires for towers and inflatable or rigid construction, as cables for holding captive balloons, for suspending or towing gear lowered deep into the ground or the sea, or for towing, making fast or anchoring floating objects.

In all these applications, the rope is stored on a winch, and is wound and unwound many times on winding diameters as small as possible to decrease overall dimensions.

A number of ropes of this type and manufacturing methods are know at present. In general, the methods known consist in impregnating fibres arranged longitudinally or stranded. The impregnating material is thermosetting; it adheres to the fibres of filaments after a polymerisation, reticulation or vulcanisation reaction.

Epoxy resins, polyesters or elastomers are generally used to this end. Whatever the fibres used, these resins harden and become brittle, and the fibres thus bonded together can no longer move with respect to one another. This is in particular the case with bonded fibre glass ropes.

The object of the bonding is to compensate for differences in fibre lengths and to prevent abrasion of the fibres against one another. The methods known enable these conditions to be met. Unfortunately, the disadvantage of these methods and the ropes made by it is the absence of flexibility, which requires winding drums to have a large diameter, thus considerably increasing the overall dimensions and the cost of the devices carrying such ropes.

The object of the present invention is to overcome these disadvantages and to provide a method for producing flexible ropes which can be wound onto small diameter drums, while having improved mechanical and physical properties (particularly breaking strength, elongation, specific weight, etc.) compared with those of the ropes made by the known methods and which provide improved surface protection while avoiding the mutual abrasion of fibres.

To this end, the invention relates to a method characterised in that a braid is made with or without a core, the whole being impregnated with a treatment product which fixes on the braid and which is then dried.

According to another characteristic feature of the invention, the braid is impregnated with the aid of a product chosen among the group consisting of fluorocarbon resins, anti-stick products, products with a small friction coefficient, silicone oils, and polyester urethanes, with elongated chains.

According to a particularly interesting characteristic feature, the rope is provided with a sheath after drying.

The invention also relates to a plant for the application of the method.

The plant is characterised in that it consists of a braider making a braided rope, and impregnation means containing the impregnation product, a drying oven to remove the solvent from the impregnated product, a device for producing a continuous surface, followed by a pulling device and finally, by a drum onto which the finished rope is wound.

According to another characteristic feature, the device for producing a surface is an extruder which provides the rope with a sheath or a die which polishes the impregnation product.

According to one variant, the rope surface coating device consists of a sizing tank and an extruder.

Lastly, the invention also relates to the ropes produced in this way.

Thanks to the invention, a very strong and flexible rope is produced, whose fibres can move with respect to one another and give the rope the great flexibility that is sought, while avoiding any mutual abrasion of its fibres.

In the first case, the braid or braids are made anti-gyratory to maintain the impregnation correctly within the rope so that these products can play their role of inter-fibre lubricant. In the second case, the braid fibres are bonded by means of a resilient product. As the ropes are made in superimposed, concentric braids with a long pitch, the fibres retain their original mechanical properties, and the thick coating of the braids (of the order of 80 to 100 %) ensures that the impregnated products remain in place.

In general, high performance mechanical fibres must be grouped in one direction and parallel and close to a logitudinal arrangement; braiding with a long pitch is therefore an essential characteristic for such performance.

It has thus been possible through experience and by a number of tests to determine the braiding angle suitable for "KEVLAR" fibres which are made from an aromatic polyamide.

These maintain their mechanical properties with a braiding angle $\alpha$ of less than 10°, thus determining the braiding pitch by means of the formula:

$$P = \pi \, D \, \mathrm{Cotg}\alpha$$

For example, the pitch of a 1.5 mm diameter rope braided at an angle $\alpha = 8°$, is 33 mm. The superimposed braids must always have the same angle $\alpha$. This being so, Cotg $\alpha$ being kept constant, the pitch P becomes proportional to the diameter D.

Successive braids can be made by progressively increasing the number of strands, for example 8, 12, 16, 24, etc....

By means of the methods according to the invention, it is reasonably possible to make ropes with up to 5 braids with KEVLAR fibres of 1 500 deniers(1667 Decitex), having successive diameters of about 2 - 2.5 - 3.5, enabling breaking stresses of 280 daN (diameter 1.5 ) to 1900 daN (diameter 3.5) to be obtained.

Tables A and B below summarise the principal properties obtained with the variant of the method applied to KEVLAR fibres.

TABLE A

| Ropes made of superimposed braids | | | | | |
|---|---|---|---|---|---|
| Number of braids | Number of strands | Diameter in m/m | Weight grams/meters | Breaking strength deca Newton | Elongation at rupture (as %) |
| 1 | 8 | 0.7 | 0.4 | 68 | 2 |
| 1 | 10 | 1.5 | 2.13 | 280 | ≦3.2 |
| 2 | 18 | 2 | 3.65 | 460 | ≦3.2 |
| 3 | 34 | 2.5 | 7 | 900 | ≦3.2 |
| 4 | 50 | 3 | 11 | 1300 | ≦3.2 |
| 5 | 74 | 3.5 | 16 | 1900 | ≦3.2 |

For greater strengths, it is advised to make ropes by assembling ropes in combination of 7(1 central rope + 6 peripheral ropes) of 19(1 + 6 + 12) of 37(1 + 6 + 12 + 18) in reversed layers to retain the anti-gyratory properties of the element of braided rope in the rope that has been obtained in this way.

TABLE B

Ropes made by assembling preceding ropes of 1.5 mm diameter.

| Composition of assembly | Number of elementary ropes | Diameter of assembly (in m/m) | Weight grams/meter | Breaking strength deca Newton | Elongation at rupture (as %) |
|---|---|---|---|---|---|
| 1 + 6 | 7 | 4.4 | 15.5 | 2000 | <3.4 |
| 1 + 6 + 12 | 19 | 7.2 | 42 | 5150 | <3.4 |
| 1 + 6 + 12 + 18 | 37 | 10.1 | 82 | 10000 | <3.4 |

In this way it is possible to reach a breaking strength Rr of 70 000 daN and, by a new assembly in the same combinations obtain even thicker ropes, limited only by the capacity of the material.

In the case of assemblies, the impregnation with polyester urethane, as described above, is particularly recommended because it causes the constituent element to retain its cylindricity enabling mutual gliding to take place on two genetrices.

It is essential that the assembly of the braided ropes have the same braiding angle $\alpha$ of the elements or very close to it.

In general, the theoretical calculation of a rope according to the invention, is simple and close to reality. Thus knowing the strength and the weight of a fibre, packed in a braid, and the thickness of the braids, the characteristics of the rope, namely, its strength, weight, diameter and elongation, can easily be calculated.

The present invention will be described in more detail with the aid of the accompanying drawings in which.

First, a rope is made with or without a core (not shown), starting, if necessary with a core that is impregnated before the braider so that the product penetrates into the braid. The impregnation product is in general the same as that used subsequently.

Figure 1:
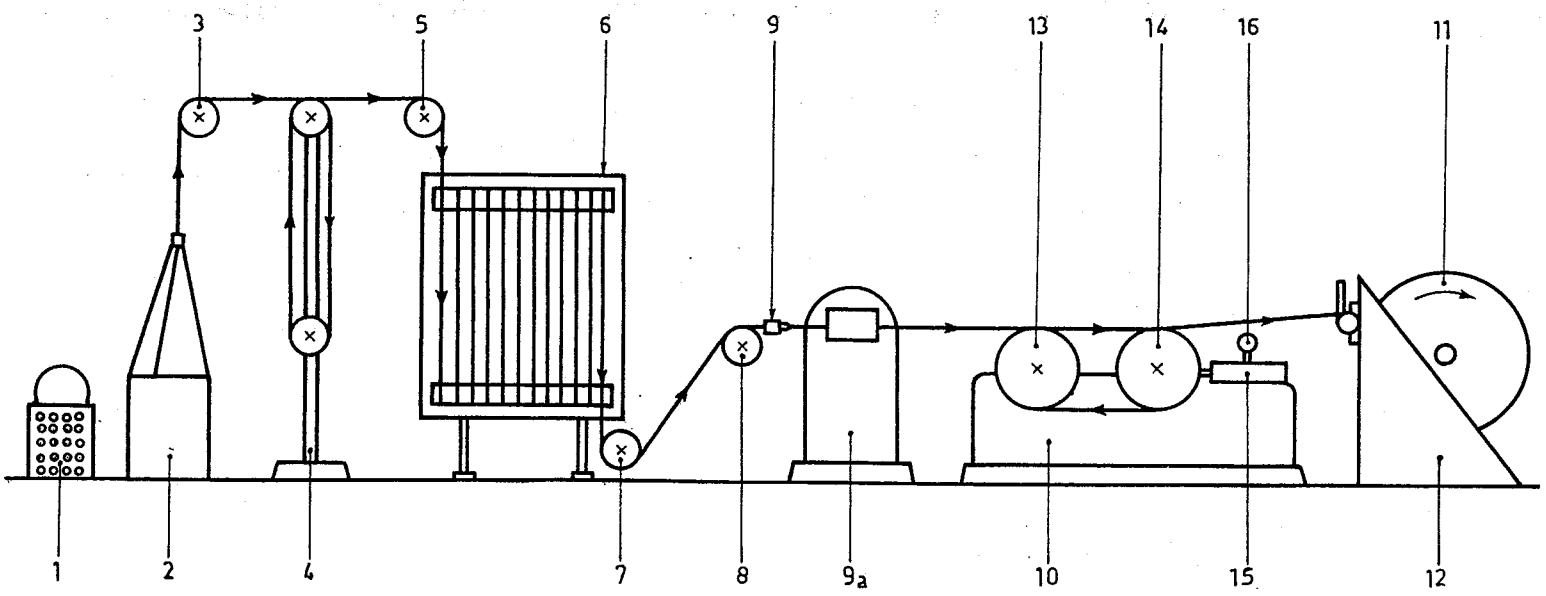
FIG. 1 is a schematic view of a plant for the manufacture of ropes according to the invention.

According to FIG. 1, the rope, coming from the braider, not shown, is placed in a basket 1, which is immersed in an impregnation tank of the reeler 2. The rope is extracted from the tank, placed in a reeler 2, passing over an intermediate pulley 3, provided with a brake.

The same results may be obtained by using a reel and passing the braid through an impregnation bath 2, provided with multi-grooved pulleys (not shown in the figures).

The rope is then passed over a tension regulator 4 and, into an over 6, over an intermediate pulley 5.

On leaving the oven 6, the rope passes over two pulleys 7,8 and enters the extruder 9. The rope leaving the extruder passes onto a capstan 10, whose speed is adjustable, consisting of two pulleys 13 and 14. The pulley 14 is carried by a bearing integral with a jack 15, which enables a determined pull to be exerted on the rope, while continuouly checking the tensile strength of the rope.

The measuring device 16, integral with the jack 15, enables the pressure of the fluid in the jack to be checked. This device 16 is, for example, a manometer.

On leaving the pulley 14, the rope passes over a reel 11, carried by the frame 12.

In the above plant, the assumption was made that the rope was of the single braid type. It is evident that in the case of multi-braid ropes, these would be made successively, with the impregnations being made simultaneously or successively.

For impregnation in the tank 2, it is important to use an aqueous dispersion of a fluorocarbon resin(tetrafluoro ethylene or fluorinated ethylene-propylene) in the form of fine particles, maintained in suspension in water. These dispersions are hydrophobic colloids with a negative charge containing particles, for example, of 0.05 to 0.5 micron, in suspension in the water.

A non-ionic wetting agent is added to facilitate the penetration of the particles in the meshes and into the heart of the braid.

The natural tendency of fibres to acquire a surface moisture film (in most cases 2 to 3%) facilitates the conveyance of the aqueous dispersion to the filaments of the fibre.

It is possible to obtain concentration of about 60% of solid particles. These dispersions can be found in commerce, ready for use, together with their wetting agent.

After the water and the wetting agent have been used for impregnating the braid in the tank 2, they must be removed before the outer sheath is made.

The removal operation is carried out in the oven 6, which is heated electrically or by means of infra-red rays.

The temperature is raised gradually to avoid the formation of bubbles in the mass (from 100° to 150°C, at least, and if possible, up to 200°C, to eliminate all traces of the wetting agent). This temperature is limited by the temperature bearing characteristics of the fibre itself.

Water must be removed completely from the rope in order to enable it to retain its dielectric properties, which are essential in some applications. The entire heating process can be easily controlled by measuring the current losses in a high tension test (10 to 20 kv) at a frequency of 1000 Hz of a 3m sample.

On leaving the oven 6, the rope is checked slightly and glazed by passing it through the die 9 or over grooved rollers (not shown) subjected to heating.

The calibrated die 9 compresses the particles and braids, rendering the whole homogeneous.

For some applications that are more difficult to handle, the rope is finished by providing it with an impervious sheath which permanently encloses the particles inside the braids.

In the cases where the fibres used can withstand a temperature of the order of 400°C without appreciable degradation of their mechanical and physical properties, the sheath is made by sintering, tetrafluoroethylene being chosen as the impregnating material. By passing the rope or the die itself through a hot air or infra-red oven (not shown), the impregnating material is baked superficially (at about 380°C), the tetrafluoroethylene particles sintering at that temperature almost instantaneously.

In the case where the fibre cannot be raised to such high temperatures, the last braid is impregnated with an impermeable material which is sufficiently elastic to follow deformation movement without participating in it.

When the last braid has been made and removed from the braider, it is passed through the same plant as before or through a similar plant with different oven temperature settings.

The following mixture by weight example can be used:

100 parts of polyester urethane with elongated chains that is to be polymerised, 12 parts of polyfunctional aromatic isocyanate, serving as a filament reticulating and adherence agent, 1.6 parts of an organic nitrogen derivative, combined with a metallic compound serving as an accelerator and anti-cryptogamic agent, 1 part of polyurethane wax, to prevent the windings from adhering to one another on the receiving reel.

The above proportions can be modified so as to obtain greater flexibility, greater adherence or a different polymerisation time.

This mixture is particularly advantageous for the properties it imparts to ropes, namely, flexibility, resistance to abrasion and tearing, and ageing, under the influence of oxygen or ozone, or bad weather, and to organic solvents, fatty products and oils.

In order to facilitate the preparation of the mixture and its penetration into the braid, the products that constitute it should be used in a solution such as ethyl acetate.

In general, the following concentrations in ethyl acetate are chosen:

1 - a 10 to 15% solution for the pre-polymerised polyester urethane;

2 - a 75% solution for the reticulant;

3 - a 10% solution for the accelerator;

4 - a solution of the same fluidity as 2 and 3 of polyurethane wax.

According to a first variant, in order to increase impermeability, a lining, impermeable to fluorocarbon resin particles can be used in the form of a ribbon under the last braid.

This ribbon, preferably made of polyurethane, will adhere to itself and to the fibres when these are being impregnated. The way it is fitted will be described later in FIG. 2.

According to a second variant, by using all the elements or part of them which have been described, a sheath is made by extruding a polyurethane elastomer, after the impregnating material has been dried. This sheath adheres to the braid by means of the impregnating material which has not yet reached its complete polymerisation state.

If this operation is carried out immediately before the drying oven stage, the polyurethane wax can be left out of the composition of the mixture.

The polished and shiny sheath gives not only a finish, but also constitutes a particularly efficient means of preventing the formation of hoar frost of ice during winter, and the adherence of water or dust.

According to a third variant, it is possible, particularly with thick ropes, to use a ribbon for every two to three braids, in order to ensure that the fluorocarbon resin particles stay in layers in hermetically sealed spaces.

These methods and principally this variant are in particular compatible with the new du Pont de Nemours fibers of an aromatic polyomide, recently commercialised under the name of "KEVLAR."

Their very high performances - the highest in the world at present — as regards specific strength (ratio of rupture to density) and mechanical strength per unit cross-sectional area, are very clearly optimised by the variant of the method.

Thus the density of polyester urethanes is of the order of 1.2, and thus below that of the fibres which is 1.5.

The "specific" strength is thus optimised.

The adherence properties of polyester urethanes, due principally to the presence and the action of the aromatic isocyanate, serving moreover as a reticulant on the degreased Kevlar fibres, are such that the solvent is removed and the polymerisation cycle initiated; the section of the stretched rope is maintained after handling. The strength per unit cross-sectional area is therefore optimised.

The elastic polyester bond at the recommended concentrations is efficient in that it gives the rope thus produced sufficient elasticity.

The method for impregnating with fluorocarbon resin which has been described gives the rope greater elasticity but lesser specific strength (density of solid particles of the order of 2).

Lastly, the elastic and adherent bond made by impregnation with polyester urethanes enables the original cylindricity of the rope to be maintained, however it is handled and whatever the equipment is used in this connection.

Without departing from the scope of the present invention, it is of course understood that the elements of the braid can be pre-impregnated or finally impregnated before the braiding operation using the composition of the different impregnation products, described above.

Figure 1A:
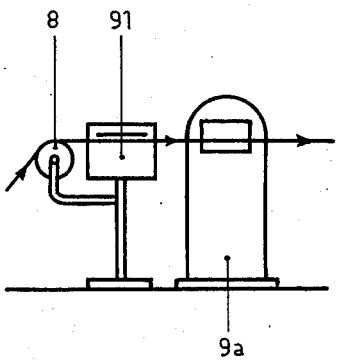
FIG. 1A shows a variant of the plant, according to FIG. 1.

According to a variant of the method according to the invention, a plant similar to that in FIG. 1 is used in which the extruding means 91 is replaced by a sizing tank 9' and an extruder **9*a*, FIG. 1A**.

Beforehand, in the braider, the braid core will have been passed, which is done in the impregnating bath. This bath, as well as the final impregnating operation in the tank 2, consists of a mixture of polyester urethane - reticulant - accelerator and the previously described wax in the solution with the lowest viscosity, that is to say, at a concentration of 10%, for example, of polyester urethane in ethyl acetate.

This composition enables the impregnation to be reticulated completely within two or three days, which leaves sufficient time to store the ropes if it is desired to separate the extrusion or coating operations from the impregnation or drying operations.

This impregnation operation as well as the preceding operation can be carried out in tanks, either continuously or in batches.

Dyestuffs can also be added to enable the ropes to be identified or to improve their appearance.

According to the invention and its present variant, the impregnated braid passes through the oven 6 (hot air blown or drawn through) to remove all the solvent.

The temperature between the point at which the rope enters and leaves the oven rises progressively from 60° to 110°C (for ethyl acetate) to avoid the formation of bubbles in the mass.

On leaving the oven, the rope rapidly passes into a tank containing a mixture of the same products, in order to ensure homogeneous and adherent bonding with the sheath during the following operation.

This mixture is in a concentration of solvent of greater viscosity, for example:

-20 to 30% of pre-polymerised polyester urethane,

-75% of reticulant,

-10% of accelerator

For costs or technical reasons of weight or dimensions, the protective sheath may be omitted for its presence does not increase the mechanical properties or the flexibility of the rope in the least.

Nevertheless, it is recommended in this case, to prevent any possible porosity, to pass the rope through a low viscosity bath of dielectric silicone oil.

As before, the absence and non-attraction of humidity, can easily be checked dry and after immersion in water by measuring current losses in a high tension test (10 to 20 kV) at a frequency of 1000 Hertz using a 3m long sample.

However, it is important to surround the rope with a protective sheath made after the removal of the solvent at the outlet of the oven 6.

The rope can be provided with a sheath either by extrusion, a simple operation, or by coating.

On leaving the extruder 9*a* and the cooling tank, not shown, the rope passes over the pulley 13 of FIG. 1, and is wound onto the reel 11 after checking its tension.

Figure 2:
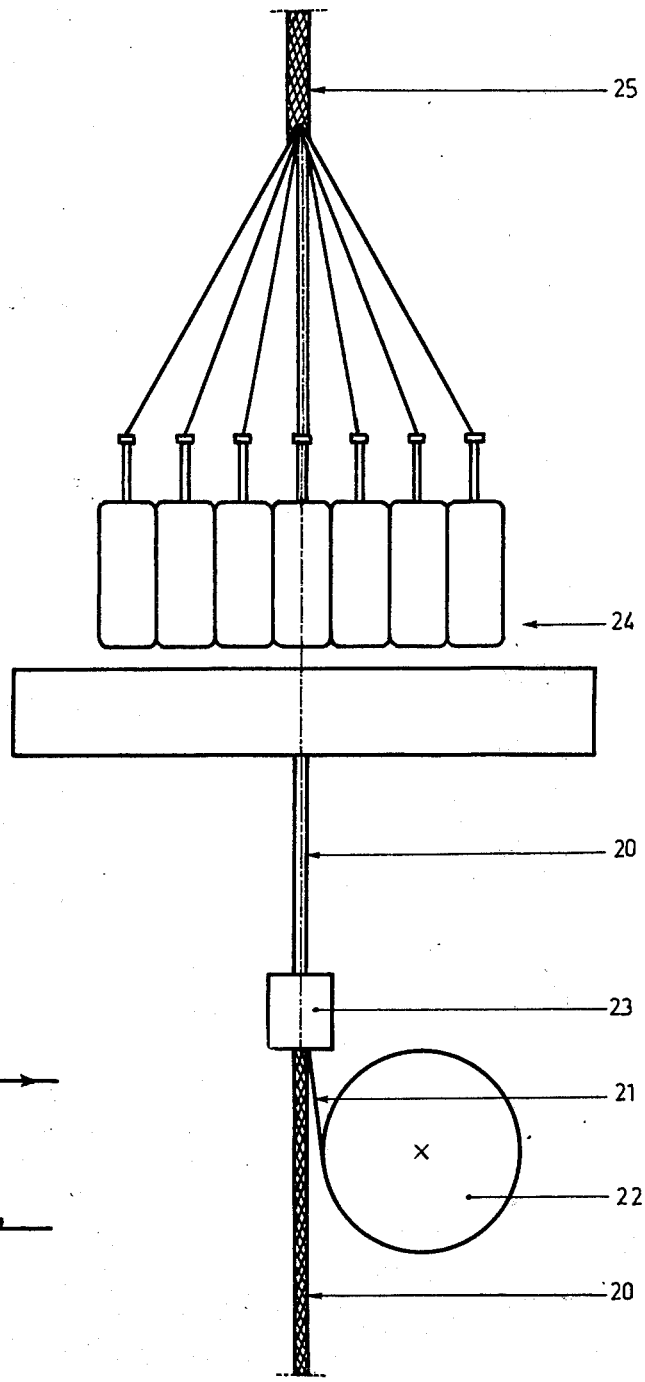
FIG. 2 is a schematic view of a braiding machine for making a rope according to the invention.

FIG. 2 shows a device enabling a ribbon to be put under the braid.

This device receives the core 20 of the rope. A ribbon 21 from the reel 22 is wound longitudinally or helicoidally onto this core. The ribbon is fitted from the reeler 23. After this, the rope 20 penetrates into the braider 24, from it emerges braided. The braider, which is a known device, will not be described in detail.

As indicated above, the core 20 can be impregnated and dried before penetrating into the device according to FIG. 2. On leaving this device, the braid is again impregnated in the manner described above.

Of course, the invention is not limited to the examples of of its embodiment herein above described and illustrated and on the basis of which other modes and forms of embodiment can be envisaged without departing from the scope of the invention.

What I claim is:

1. A method of making braided ropes of aromatic polyamide fibers in a manner to provide high strength, little elongation and high flexibility and which are resistant to deterioration comprising the steps of: providing a plurality of strands of aromatic polyamide fibers, braiding said fibers together to form a rope, impregnating said braid with an aqueous dispersion of a flurocarbon resin, heating said rope to remove moisture therefrom, applying a predetermined tension on said rope, and removing said rope.

2. The method of claim 1 in which the step of impregnating said rope includes a non-ionic wetting agent.

3. The method of claim 1 including the step of extruding a sheath onto said rope after the rope has been heated.

4. The method of claim 3 in which said sheath is made of a polyurethane elastomer.

5. The method of claim 1 including the step of applying a polyurethane wax to said fibers to prevent the braids from adhering to each other.

6. The method of claim 1 including the step of glazing the rope by passing the rope through a die after the heating step to compress the particles and braids.

7. A method of making braided ropes of aromatic polyamide fibers in a manner to provide high strength, little elongation and high flexibility and which are resistant to deterioration comprising the steps of: providing a plurality of strands of aromatic polyamide fibers, braiding said fibers together to form a rope, impregnating said braid with a solution of polyester urethane and aromatic isocyanate, heating said rope to remove moisture therefrom, applying a predetermined tension on said rope, and removing said rope.

* * * * *